US010365575B2

(12) United States Patent
Kinuta et al.

(10) Patent No.: US 10,365,575 B2
(45) Date of Patent: Jul. 30, 2019

(54) CHARGING MEMBER, PROCESS CARTRIDGE, AND IMAGE FORMING APPARATUS

(71) Applicant: FUJI XEROX CO., LTD., Tokyo (JP)

(72) Inventors: Yasuhiko Kinuta, Kanagawa (JP); Takuya Yamamoto, Kanagawa (JP); Yuki Tagawa, Kanagawa (JP)

(73) Assignee: FUJI XEROX CO., LTD., Minato-Ku, Tokyo (JP)

( * ) Notice: Subject to any disclaimer, the term of this patent is extended or adjusted under 35 U.S.C. 154(b) by 10 days.

(21) Appl. No.: 15/718,304

(22) Filed: Sep. 28, 2017

(65) Prior Publication Data

US 2018/0231907 A1 Aug. 16, 2018

(30) Foreign Application Priority Data

Feb. 15, 2017 (JP) ..... 2017-026295

(51) Int. Cl.

| | |
|---|---|
| ***G03G 15/00*** | (2006.01) |
| ***G03G 15/02*** | (2006.01) |
| *G03G 21/18* | (2006.01) |

(52) U.S. Cl.
CPC ..... *G03G 15/0233* (2013.01); *G03G 21/18* (2013.01)

(58) Field of Classification Search
CPC ..... G03G 15/0233; G03G 21/18
See application file for complete search history.

(56) References Cited

U.S. PATENT DOCUMENTS 9,817,328 B2 * 11/2017 Miura ..... G03G 15/0233
2015/0050052 A1 * 2/2015 Hoshio ..... G03G 15/0216 399/176

FOREIGN PATENT DOCUMENTS

JP 2016-141128 A 8/2016

* cited by examiner

*Primary Examiner* — Walter L Lindsay, Jr.
*Assistant Examiner* — Jessica L Eley
(74) *Attorney, Agent, or Firm* — Sughrue Mion, PLLC

(57) ABSTRACT

A charging member includes a cylindrical, hollow or solid, electroconductive base member, and an elastic layer device disposed on the electroconductive base member. When a surface profile of the charging member is subjected to a periodicity analysis in a circumferential direction, the surface profile has a maximum amplitude, in a period region of smaller than 5 mm, within a range of higher than or equal to 0.20 μm and smaller than or equal to 0.90 μm.

17 Claims, 8 Drawing Sheets

CHARGING MEMBER, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2017-026295 filed Feb. 15, 2017.

BACKGROUND (i) Technical Field

The present invention relates to a charging member, a process cartridge, and an image forming apparatus.

(ii) Related Art

An electrophotographic image forming apparatus forms an intended image by firstly charging a surface of an image carrier, which is an inorganic or organic photoconductor, using a charging device to form a latent image on the surface, developing the latent image with charged toner into a visible toner image, transferring the toner image to a recording medium such as a recording sheet directly or using an intermediate transfer body, and then fixing the toner image to the recording medium.

SUMMARY

According to an aspect of the invention, a charging member includes a cylindrical, hollow or solid, electroconductive base member, and an elastic layer device disposed on the electroconductive base member. When a surface profile of the charging member is subjected to a periodicity analysis in a circumferential direction, the surface profile has a maximum amplitude, in a period region of smaller than 5 mm, within a range of higher than or equal to 0.20 μm and smaller than or equal to 0.90 μm.

BRIEF DESCRIPTION OF THE DRAWINGS

Exemplary embodiments of the present invention will be described in detail based on the following figures, wherein.

DETAILED DESCRIPTION

Figure 1:
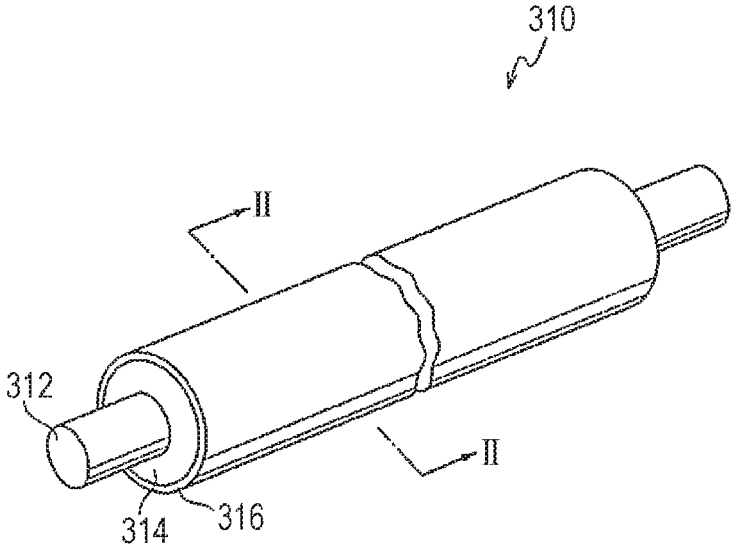
FIG. 1 is a schematic perspective view of a charging member according to an exemplary embodiment.

An exemplary embodiment, which is an example of the present invention, is described below.

Charging Member

A charging member according to the present exemplary embodiment includes a cylindrical, hollow or solid, electroconductive base member and an elastic layer disposed on the electroconductive base member. When the surface profile of the charging member is subjected to a periodicity analysis in a circumference direction, the surface profile has a maximum amplitude, in a period region of smaller than 5 mm, within a range of higher than or equal to 0.20 μm and smaller than or equal to 0.90 μm.

A charging member according to the present exemplary embodiment is, for example, disposed in contact with a chargeable body (such as an image carrier) and charges the chargeable body while being in contact with the chargeable body in response to an application of a voltage.

Herein, being electroconductive refers to having a volume resistivity of smaller than or equal to $1\times10^{14}$ Ω·cm at 20° C.

When the charging member disposed in contact with the surface of an image carrier has a rough surface profile in the circumferential direction, the image carrier vibrates with a rotation of the charging member. When the image carrier vibrates, the position at which the exposure device forms a latent image (written position) changes, and the image may have density irregularity. Particularly, when an image carrier, a charging member, and an exposure device including a light emitting diode as a light source are integrally held in a housing, the vibration of the charging member is transmitted to the exposure device through the housing and the position at which the exposure device forms a latent image (written position) changes and the image is more likely to have density irregularity.

When, on the other hand, the charging member has an excessively smooth surface profile in the circumferential direction, the image carrier vibrates due to vibrations caused by members other than the charging member. Thus, the position at which the exposure device forms a latent image (written position) changes, and the image may have density irregularity.

A charging member according to the present exemplary embodiment thus has a surface profile having a maximum amplitude within a range of higher than or equal to 0.20 μm and smaller than or equal to 0.90 μm in a period region of smaller than 5 mm, the surface profile being found through a periodicity analysis in a circumferential direction. The surface profile having a maximum amplitude of lower than or equal to 0.90 μm in a small period region of smaller than 5 mm reduces vibrations of an image carrier resulting from a rotation of the charging member. On the other hand, the surface profile having a maximum amplitude of higher than or equal to 0.20 μm prevents an excessive reduction of vibrations of an image carrier resulting from a rotation of the charging member. Thus, the vibrations of the image carrier resulting from a rotation of the charging member reduce the vibrations of the image carrier attributable to members other than the charging member, so that the effect of the vibrations of members other than the charging member on the image carrier is reduced.

Similarly, when the image carrier, the charging member, and the exposure device including a light emitting diode as a light source are integrally held in the housing, the vibrations of the exposure device resulting from the rotation of the charging member are reduced and, at the same time, the effect of the vibrations of members other than the charging member on the exposure device is reduced.

Thus, the charging member according to the present exemplary embodiment reduces a change of the position at which the exposure device forms a latent image (written position). Thus, the image has less density irregularity.

A charging member according to the present exemplary embodiment is described below with reference to the drawings.

Figure 2:
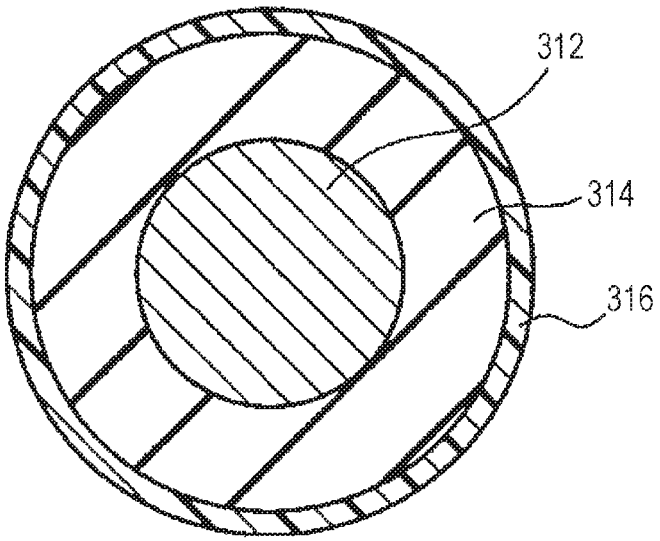
FIG. 2 is a schematic sectional view of a charging member according to the present exemplary embodiment.

FIG. 1 is a schematic perspective view of a charging member according to the present exemplary embodiment. FIG. 2 is a schematic sectional view of a charging member according to the present exemplary embodiment, taken along line II-II of FIG. 1.

As illustrated in FIGS. 1 and 2, a charging member 310 according to the present exemplary embodiment is a roller including, for example, a cylindrical, hollow or solid, electroconductive base member 312 (shaft), an elastic layer 314 disposed on the outer circumferential surface of the electroconductive base member 312, and a surface layer 316 disposed on the outer circumferential surface of the elastic layer 314.

The structure of the charging member 310 according to the present exemplary embodiment is not limited to the above structure. For example, the charging member 310 may have a structure not including the surface layer 316. In other words, the charging member 310 according to the present exemplary embodiment may be constituted of the electroconductive base member 312 and the elastic layer 314.

Alternatively, the charging member 310 may also include an intermediate layer (for example, adhesive layer) between the elastic layer 314 and the electroconductive base member 312, and a resistance adjusting layer or a shift preventive layer between the elastic layer 314 and the surface layer 316.

The charging member 310 according to the present exemplary embodiment is described in detail. The reference signs may be omitted in the following description.

Charging Member

When the charging member according to the present exemplary embodiment has its surface profile subjected to a periodicity analysis in the circumferential direction, the surface profile has a maximum amplitude within a range of higher than or equal to 0.20 μm and smaller than or equal to 0.90 μm in a period region of smaller than 5 mm. From the view point of reduction of image density irregularity, the maximum amplitude preferably falls within a range of higher than or equal to 0.20 μm and smaller than or equal to 0.60 μm, more preferably, within a range of higher than or equal to 0.20 μm and smaller than or equal to 0.45 μm.

When the charging member has its surface profile subjected to a periodicity analysis in the circumferential direction, from the view point of reduction of image density irregularity, the surface profile preferably has a maximum amplitude, in a period region of higher than or equal to 5 mm and smaller than or equal to L mm, within the range of higher than or equal to 1.0 μm and smaller than or equal to 5.0 μm, more preferably, higher than or equal to 1.0 μm and smaller than or equal to 3.0 μm, where the outer perimeter of the charging member is assumed to be L mm.

Compared to the amplitude in a period region of smaller than 5 mm, the amplitude in a period region of higher than or equal to 5 mm and smaller than or equal to L mm has a smaller effect on the vibrations of the image carrier. However, the image has lesser density irregularity when the amplitude in a period region of higher than or equal to 5 mm and smaller than or equal to L mm is within the above range.

When the charging member has its surface profile subjected to a periodicity analysis in a circumferential direction, the surface profile preferably has an average amplitude, in a period region of higher than or equal to 1.5 mm and smaller than 5 mm, within a range of higher than or equal to 0.1 μm and smaller than or equal to 0.4 μm, more preferably, higher than or equal to 0.1 μm and smaller than or equal to 0.3 μm, from the view point of reduction of image density irregularity.

The periodicity analysis on the surface profile of the charging member in the circumferential direction is performed in the following manner.

Firstly, a roundness cylindrical-shape measuring instrument is used to measure, at the intervals at which the full length of the elastic layer of the charging member (full length is a length of the charging member in the axial direction) is equally divided into nine pieces, the profiles of the nine sections of the charging member (sections taken perpendicularly to the axial direction of the charging member). Thus, the amplitude of the profile of each section of the charging member is obtained. The profile of each section of the charging member is measured under the following conditions:

Roundness cylindrical-shape measuring instrument: RondCom 60A from Tokyo Seimitsu Co., Ltd.

Detector: low voltage detector compatible with RondCom 60A (E-DT-R87A from Tokyo Seimitsu Co., Ltd.)

Waviness measuring instrument: waviness measuring instrument compatible with RondCom 60A (0102505 from Tokyo Seimitsu Co., Ltd.)

Measurement magnification: 500 times

Measurement speed: 4/min

Method of finding centers: LSC

Filter: 2RC

Cut off: Low

Data extraction pitch: per 0.1°.

After the profile of each section of the charging member is measured, the obtained amplitudes of the profile of each section of the charging member for five rotations are connected. Among these, data at continuous 16384 points are subjected to the periodicity analysis by fast Fourier transform (FFT). For the amplitude of the charging member for each period, the value obtained by averaging the amplitudes of the nine sections per period is used.

Thus, the following amplitudes are thus obtained: 1) the maximum amplitude in a period region of smaller than 5 mm, 2) the maximum amplitude in a period region of higher than or equal to 5 mm and smaller than or equal to L mm (L is the outer perimeter of the charging member), and 3) the amplitude in a period region of higher than or equal to 1.5 mm and smaller than 5 mm. These amplitudes respectively refer to "1) the maximum amplitude in a period region of smaller than 5 mm, 2) the maximum amplitude in a period region of higher than or equal to 5 mm and smaller than or equal to L mm, and 3) the average amplitude in a period region of higher than or equal to 1.5 mm and smaller than 5 mm" in the description.

The properties of the surface profile of the charging member are controlled by the conditions of a method for manufacturing the charging member (elastic layer forming method), described below.

Components of the charging member according to the present exemplary embodiment are described in detail.

Electroconductive Base Member

An electroconductive base member is described now.

Examples of an electroconductive base member include a member made of metal or alloys such as aluminium, a copper alloy, or stainless steel, iron plated with chromium, nickel, or other metal, or electroconductive materials such as electroconductive resin.

The electroconductive base member functions as a supporting member and an electrode of the charging roller and is made of, for example, metal such as iron (such as free-cutting steel), copper, brass, stainless steel, aluminium, or nickel. Examples of the electroconductive base member include a member having a plated outer circumferential surface (such as resin or ceramic member) and a member having an electroconductive agent dispersed therein (such as resin or ceramic member). The electroconductive base member may be a hollow member (tubular member) or a solid member.

Elastic Layer

An elastic layer is described now.

The elastic layer is an electroconductive layer containing, for example, an elastic material and an electroconductive agent. The elastic layer may contain other additives, as appropriate.

Examples of elastic materials include isoprene rubber, chloroprene rubber, epichlorohydrin rubber, butyl rubber, polyurethane, silicone rubber, fluoro rubber, styrene-butadiene rubber, butadiene rubber, nitrile rubber, ethylene-propylene rubber, epichlorohydrin-ethylene oxide copolymer, epichlorohydrin-ethylene oxide-allyl glycidyl ether copolymer, ethylene-propylene-diene terpolymer (EPDM), acrylonitrile-butadiene copolymer (NBR), natural rubber, and a mixture of any of these. Among these examples, preferable examples as the elastic material include polyurethane, silicone rubber, EPDM, epichlorohydrin-ethylene oxide copolymer, epichlorohydrin-ethylene oxide-allyl glycidyl ether copolymer, NBR, and a mixture of any of these. These elastic materials may be a foamed or unfoamed material.

Examples of an electroconductive agent include an electronic electroconductive agent and an ionic electroconductive agent. Examples of an electronic electroconductive agent include powder of: carbon black such as ketjenblack or acetylene black; pyrolytic carbon; graphite; variable electroconductive metals, such as aluminium, copper, nickel, or stainless steel, or alloys thereof; variable electroconductive metallic oxides such as a tin oxide, an indium oxide, a titanium oxide, a tin oxide-antimony oxide solid solution, or a tin oxide-indium oxide solid solution; and an insulating material having a surface subjected to electroconductive processing. Examples of an ionic electroconductive agent include a perchlorate or chlorate, such as tetraethylammonium or lauryltrimethylammonium, and an alkali metal or alkaline earth metal perchlorate or chlorate, such as lithium or magnesium.

These electroconductive agents may be used alone or in combination.

Specific examples of the carbon black include "SPECIAL BLACK 350", "SPECIAL BLACK 100", "SPECIAL BLACK 250", "SPECIAL BLACK 5", "SPECIAL BLACK 4", "SPECIAL BLACK 4A", "SPECIAL BLACK 550", "SPECIAL BLACK 6", "COLOUR BLACK FW200", "COLOUR BLACK FW2", and "COLOUR BLACK FW2V", which are from Orion Engineered Carbons, and "MONARCH 1000", "MONARCH 1300", "MONARCH 1400", "MOGUL-L", and "REGAL 400R", which are from Cabot.

An average particle diameter of these electroconductive agents preferably falls within a range of higher than or equal to 1 nm and smaller than or equal to 200 nm.

The average particle diameter of the electroconductive agent is calculated by observing test samples cut out from the elastic layer with an electron microscope, measuring the diameters (maximum diameters) of 100 pieces of the electroconductive agent, and averaging the diameters. The average particle diameter may alternatively be measured with, for example, Zetasizer Nano ZS from Sysmex.

The content of the electroconductive agent is not limited to a particular value. However, the content of the electronic electroconductive agent preferably falls within the range of higher than or equal to 1 part by weight and smaller than or equal to 30 parts by weight, and more preferably, within the range of higher than or equal to 15 parts by weight and smaller than or equal to 25 parts by weight, per total 100 parts by weight of the elastic material. On the other hand, the content of the ionic electroconductive agent preferably falls within the range of higher than or equal to 0.1 parts by weight and smaller than or equal to 5.0 parts by weight, and more preferably, within the range of higher than or equal to 0.5 parts by weight and smaller than or equal to 3.0 parts by weight, per total 100 parts by weight of the elastic material.

Examples of other additives combined into the elastic layer include materials normally allowed to be added to the elastic layer, such as a softening agent, a plasticizer, a curing agent, a vulcanizing agent, a vulcanization accelerator, an antioxidant, a surfactant, a coupling agent, and a filler (for example, silica or calcium carbonate).

Preferably, the elastic layer has a thickness of higher than or equal to 1 mm and smaller than or equal to 10 mm, more preferably, higher than or equal to 2 mm and smaller than or equal to 5 mm.

Preferably, the elastic layer has a volume resistivity of higher than or equal to $10^3$ Ω·cm and smaller than or equal to $10^{14}$ Ω·cm.

The volume resistivity of the elastic layer is measured by the following method.

Sheet-form test samples are taken from the elastic layer. In conformance with JIS K 6911 (1995), a voltage adjusted to form an electric field (voltage/composite sheet thickness) of 1000 V/cm using a measuring instrument (R12702A/B resistivity chamber from Advantest Corporation) and a high-resistance measuring instrument (R8340A digital high-resistance/ultra-low-current meter from Advantest Corporation) is applied to the test samples for 30 seconds. On the basis of the flowing electric current, the volume resistivity is calculated in the following formula.

Volume resistivity(Ω·cm)=(19.63×applied voltage (V))/(electric current(A)×test sample thickness (cm))Surface Layer The surface layer contains, for example, resin. The surface layer may also contain other additives, as appropriate.

The surface layer may be, for example, a separate resin layer disposed on the elastic layer or formed by impregnating resin or the like into foams of the surface layer of the foamed elastic layer (specifically, the surface layer portion of the elastic layer having foams into which resin or the like is impregnated serves as a surface layer).

Resin

Examples of resin include acrylic resin, fluorine denatured acrylic resin, silicone denatured acrylic resin, cellulosic resin, polyamide resin, nylon copolymers, polyurethane resin, polycarbonate resin, polyester resin, polyimide resin, epoxy resin, silicone resin, polyvinylalcohol resin, polyvinyl butyral resin, cellulosic resin, polyvinyl acetal resin, ethylene tetrafluoroethylene resin, melamine resin, polyethylene resin, polyvinyl resin, polyarylate resin, polythiophene resin, polyethlene terephthalate resin (PET), and fluoro-resin (polyvinylidene fluoride resin, tetrafluoride ethylene resin, tetrafluoroethylene-perfluoroalkylvinyl ether copolymer (PFA), and tetrafluoroethylene-hexafluoropropylene copolymer (FEP)). Preferably, resin is curable resin cured or crosslinked by a curing agent or catalyst.

Here, nylon copolymers are copolymers containing at least one of nylon 610, nylon 11, and nylon 12 as a polymer unit. The nylon copolymers may contain other nylon, such as nylon 6 or nylon 66, as a polymer unit.

Among these, from the surface-layer cleaning point of view, polyvinylidene fluoride resin, tetrafluoride ethylene resin, and polyamide resin are preferable as resin, and polyamide resin is more preferable. Polyamide resin is less likely to cause frictional electrification after coming into contact with the chargeable body (such as an image carrier) and is more likely to repel toner or additives.

Examples of polyamide resin include polyamide resin written in "Polyamide Resin Handbook" by Osamu Fukumoto (Nikkan Kogyo Shimbun Ltd.). Among these, from the view point of cleaning the surface layer 316, alcohol-soluble polyamide is particularly suitable as polyamide resin. Alkoxymethylated polyamide (alkoxymethylated nylon) is more preferable, and methoxymethylated polyamide (methoxymethylated nylon) is further more preferable.

Resin may have a crosslinked structure from the view point of enhancing mechanical strength of the surface layer and reducing cracking of the surface layer.

Other Additives

Examples of other additives include known additives normally allowed to be added to the surface layer, such as an electroconductive agent, a filler, a curing agent, a vulcanizing agent, a vulcanization accelerator, an antioxidant, a surfactant, and a coupling agent.

The surface layer preferably has a thickness within a range of, for example, higher than or equal to 0.01 μm and smaller than or equal to 1000 μm, and more preferably, higher than or equal to 2 μm and smaller than or equal to 25 μm.

The thickness of the surface layer is measured in the following manner. Test samples cut out from the surface layer are measured by an electron microscope at ten points on the surface layer section, and the resultants are averaged to calculate the thickness.

The surface layer preferably has a volume resistivity within a range of higher than or equal to $10^3$ Ω·cm and smaller than or equal to $10^{14}$ Ω·cm.

The volume resistivity of the surface layer is measured in the same method for measuring the volume resistivity of the elastic layer.

Method for Manufacturing Charging Member

An example of a method for manufacturing a charging member according to the present exemplary embodiment is described together with an example of a manufacturing apparatus used in this method. With an example of the method for manufacturing a charging member and an example of the manufacturing apparatus, the precision of the surface profile of the elastic layer is enhanced by adjusting, for example, "clearances K, K2, and K3", "outer diameter ϕ and the number of holes of a breaker plate", and "a discharge head (die temperature)", which are described below. Thus, the charging member has the above surface profile properties.

Hereinbelow, the electroconductive base member (or shaft) is referred to as a "core", and a member (or roller) obtained by disposing an elastic layer on an electroconductive base member is referred to as a "rubber roller". An example of a method for manufacturing a charging member and an example of a manufacturing apparatus used in this method are described.

Manufacturing of Rubber Roller (Elastic Layer)

Figure 4:
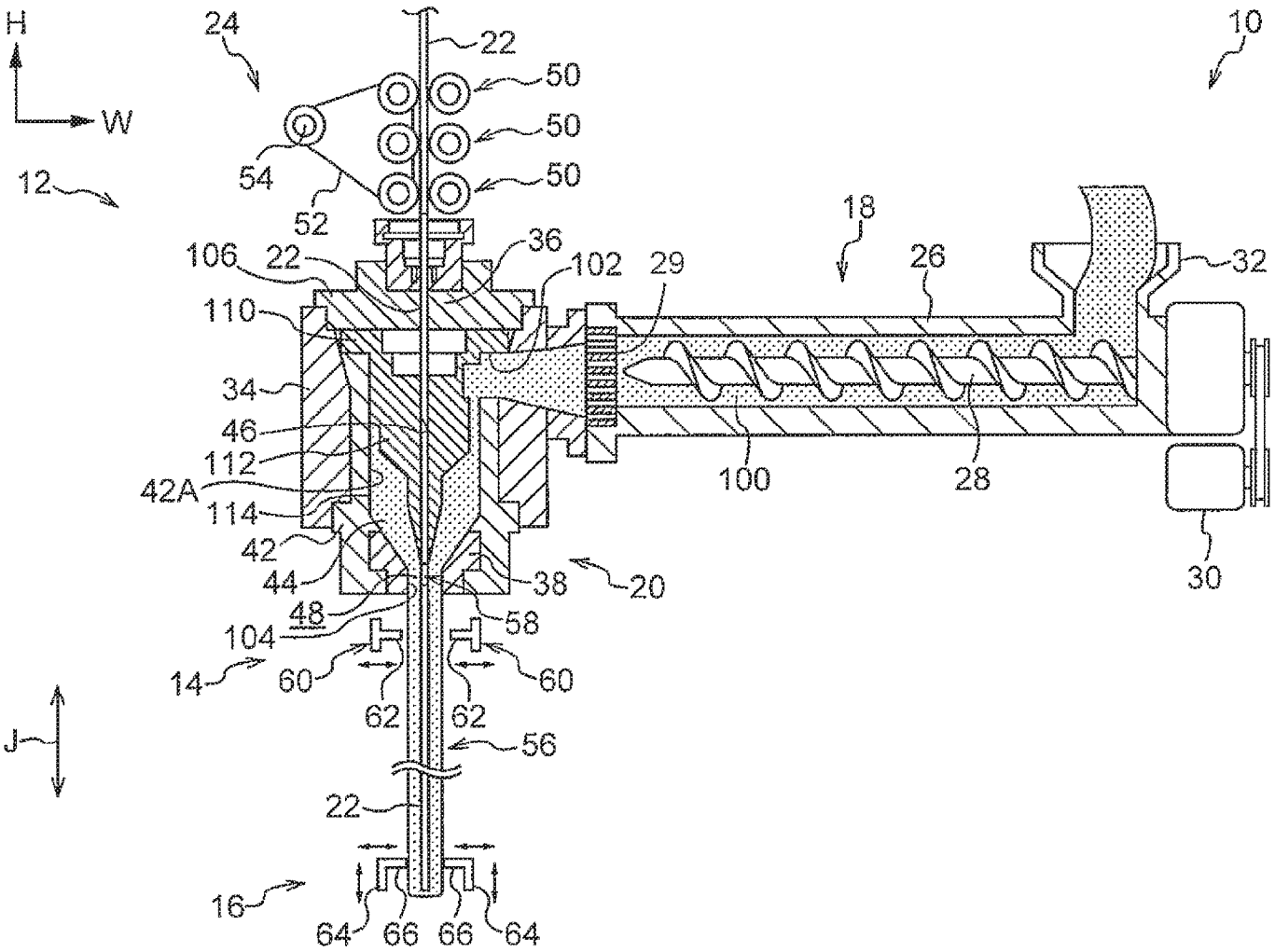
FIG. 4 is a schematic diagram of a structure of a device for manufacturing a charging member (rubber roller) according to the present exemplary embodiment.

Referring to FIG. 4, a rubber-roller manufacturing apparatus 10 is described. In the drawing, arrow H denotes an apparatus height direction (vertical direction), and arrow W denotes an apparatus width direction (horizontal direction).

Entire Structure

The rubber-roller manufacturing apparatus 10 includes an extruder 12 including a crosshead die, a separator 14 disposed under the extruder 12, and a pull-out device 16 disposed under the separator 14. The rubber-roller manufacturing apparatus 10 also includes a cutter (not illustrated).

Extruder

The extruder 12 includes a feeding portion 18, which feeds unvulcanized rubber, an extruding portion 20, which extrudes the rubber fed from the feeding portion 18 in a cylindrical tube shape, and a core transporting portion 24, which feeds a core 22 into a center portion of the cylindrical tubular rubber fed from the extruding portion 20.

Feeding Portion

The feeding portion 18 includes a screw 28, disposed inside a cylindrical tubular body 26, a heater (not illustrated) that heats rubber inside the body 26, a driving motor 30, disposed at the rear end portion (base end portion) of the screw 28 of the body 26 and driving the screw 28 to rotate, and a breaker plate 29, disposed at the front end of the screw 28 of the body 26. The feeding portion 18 also has a material inlet port 32, through which a rubber member 100 is input, at a portion of the body 26 near the driving motor 30.

The rubber member 100 (composite containing components constituting the elastic layer) input through the material inlet port 32 of the feeding portion 18 is kneaded by the screw 28 inside the body 26 and transported toward the extruding portion 20, which is an example of an outlet portion.

Extruding Portion

The extruding portion 20 includes a cylindrical tubular casing 34, connected to the feeding portion 18, and a tubular holding member 42 disposed inside the casing 34. The casing 34 has, at a side portion, an inlet port 102, through which the rubber member 100 fed from the feeding portion 18 is input. A discharge head 38 is held at the lower end portion of the holding member 42. The discharge head 38 is held by the casing 34 with the holding member 42 interposed therebetween. The discharge head 38 has an outlet port 104, through which the rubber member 100 input to the extruding portion 20 is extruded downward.

A mandrel 36, which is an example of a cylindrical tubular flow-path forming portion, is inserted into and supported by the holding member 42 inside the casing 34 of the extruding portion 20. The mandrel 36 is held by the casing 34 with the holding member 42 interposed therebetween. A top panel 106 for fixing the mandrel 36 is disposed at the top of the casing 34. An annular flow path 44, along which the rubber member 100 flows annularly, is formed by the outer circumferential surface of the mandrel 36 and an inner circumferential surface 42A of the holding member 42.

When, for example, the volume of the rubber member 100 fed to the extruding portion 20 by the feeding portion 18 along the annular flow path 44 per minute is assumed to be V, the full capacity of all paths included in the annular flow path 44 inside the extruding portion 20 for the rubber member 100 is determined to be higher than or equal to 5V and smaller than or equal to 10V. Each path is described in detail in the description of the mandrel 36.

Mandrel

The mandrel 36 has a through hole 46, through which the core 22 extends, in the center portion. The mandrel 36 has a lower portion that tapers toward the tip end, which is located near the outlet port 104 when the mandrel 36 is attached to the extruding portion 20 (also referred to as "when the mandrel 36 is in a set position"). A lower area of the tip end of the mandrel 36 serves as a merging area 48, in which the core 22 fed from the through hole 46 and the rubber member 100 fed from the annular flow path 44 merge. Specifically, the rubber member 100 is extruded in a cylindrical tube form toward the merging area 48 and the core 22 is transported into the center portion of the rubber member 100 extruded in the cylindrical tube form.

As illustrated in FIGS. 4 to 9, the mandrel 36 includes a disc-shaped base 110 supported by being surrounded by the casing 34, a base end portion 112 protruding toward the tip end from the base 110, and a distal end portion 114 protruding toward the tip end from the base end portion 112.

Figure 7:
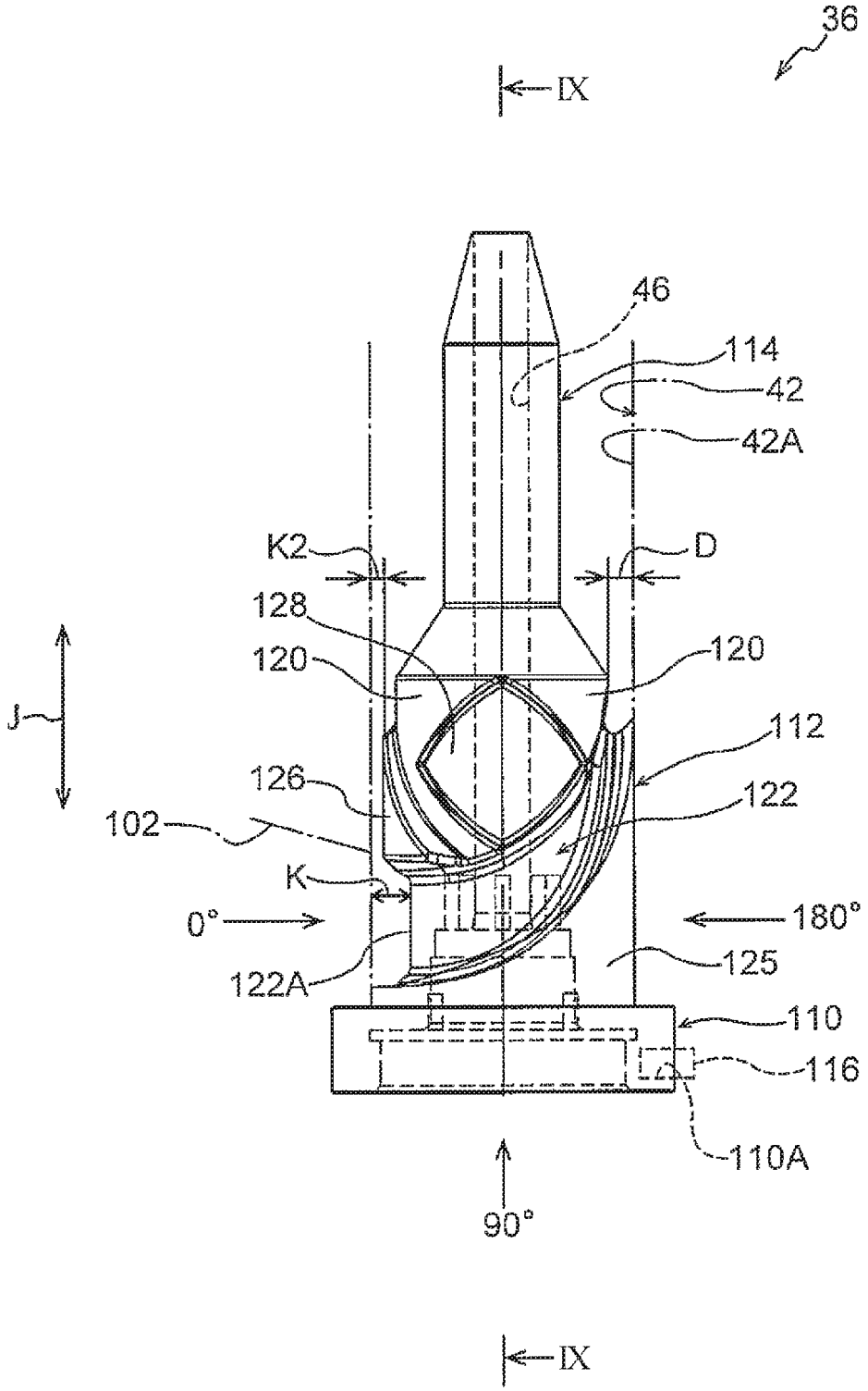
FIG. 7 is a right side view of the mandrel, which is an example of a flow-path forming portion.

The base 110 has, in a side surface, a bottomed circular hole 110A at a predetermined position. As illustrated in FIG. 7, a positioning pin 116 is allowed to be inserted into the circular hole 110A while protruding from the circular hole 110A. When the positioning pin 116 is fixed while being aligned with a positioning groove (not illustrated) in the extruding portion 20, the position of the mandrel 36 in the circumferential direction at which the mandrel 36 is attached to the extruding portion 20 is determined.

The base end portion 112 has a diameter smaller than that of the base 110 and has a cylinder tube shape having a through hole 46 (see FIG. 9) extending through its center portion. As illustrated in FIGS. 5 to 8, the outer circumferential surface of the base end portion 112 has a reference surface 120, which defines a flow path of the rubber member 100 (annular flow path 44) together with the inner circumferential surface 42A of the holding member 42.

Figure 5:
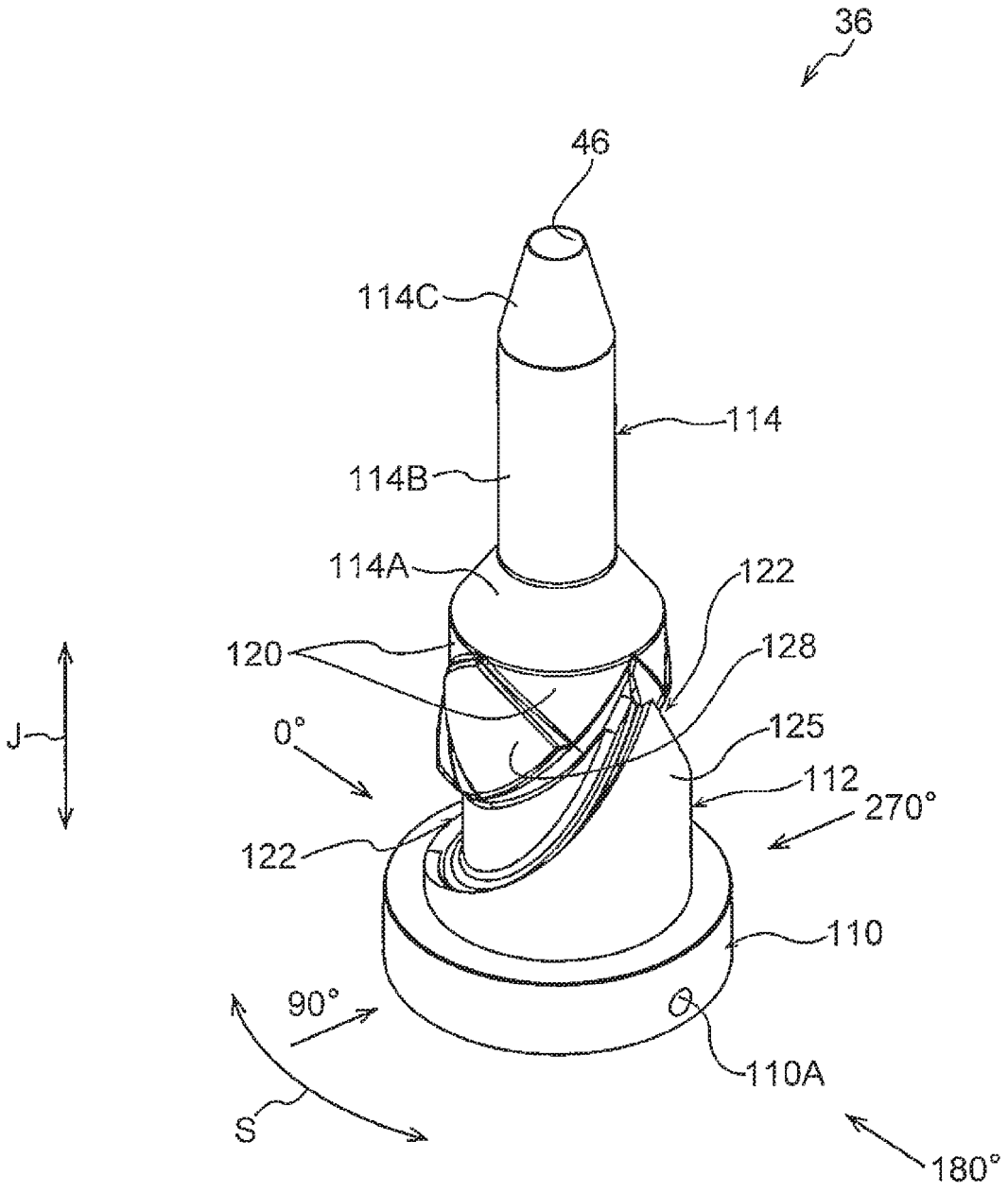
FIG. 5 is a perspective view of a mandrel, which is an example of a flow-path forming portion.

As illustrated in FIGS. 5 and 7, the base end portion 112 has grooves 122 at two different positions in the circumferential direction S. The grooves 122 extend from a zero-degree position to a 180-degree position, where the zero degree refers to a portion of the reference surface 120 in the circumferential direction S that faces the inlet port 102 in the axial direction J of the extruding portion 20, when the mandrel 36 is in the set position. The circular hole 110A is located at the 180-degree position of the base 110.

Figure 6:
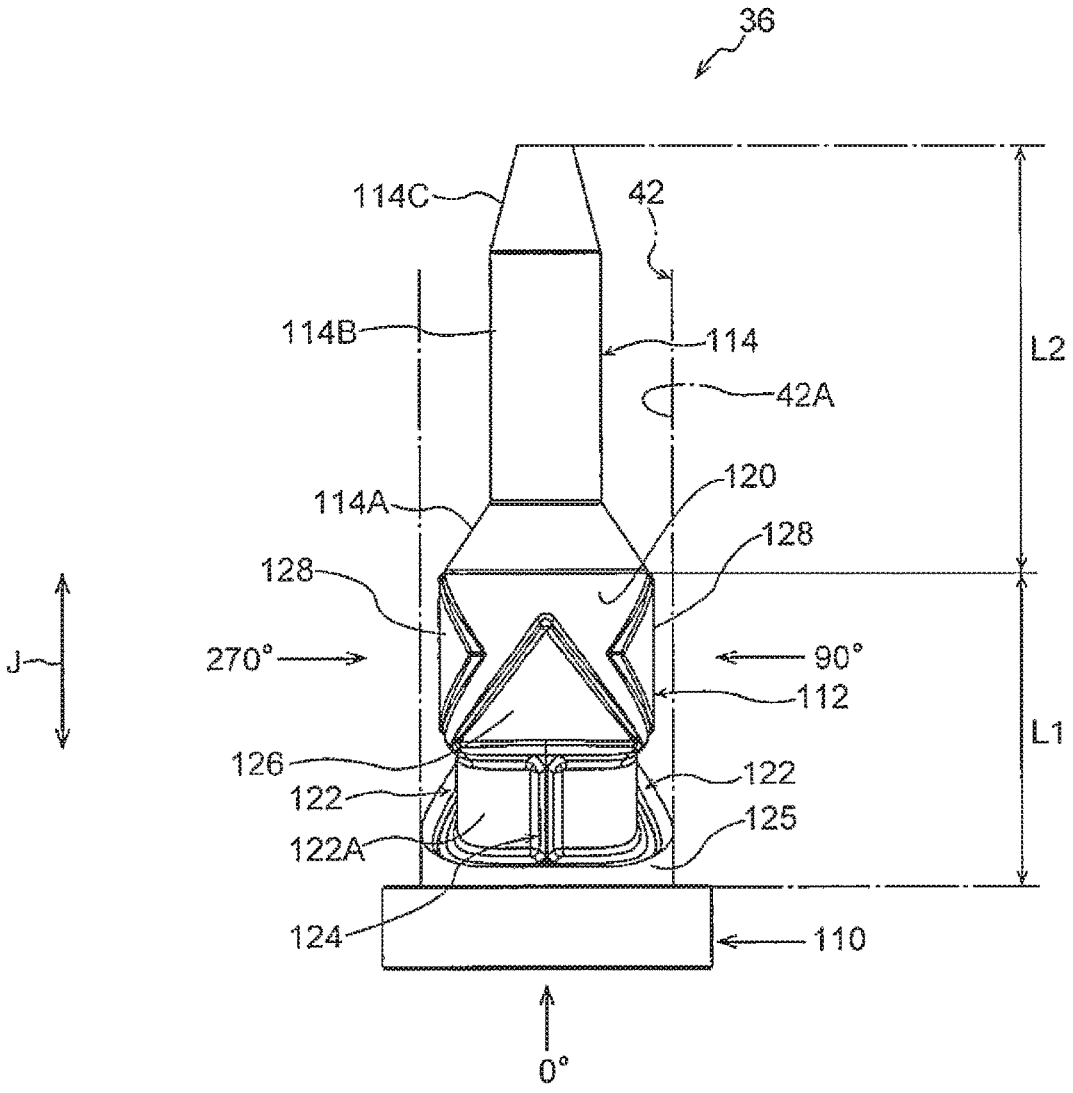
FIG. 6 is a front view of the mandrel, which is an example of a flow-path forming portion.
Figure 8:
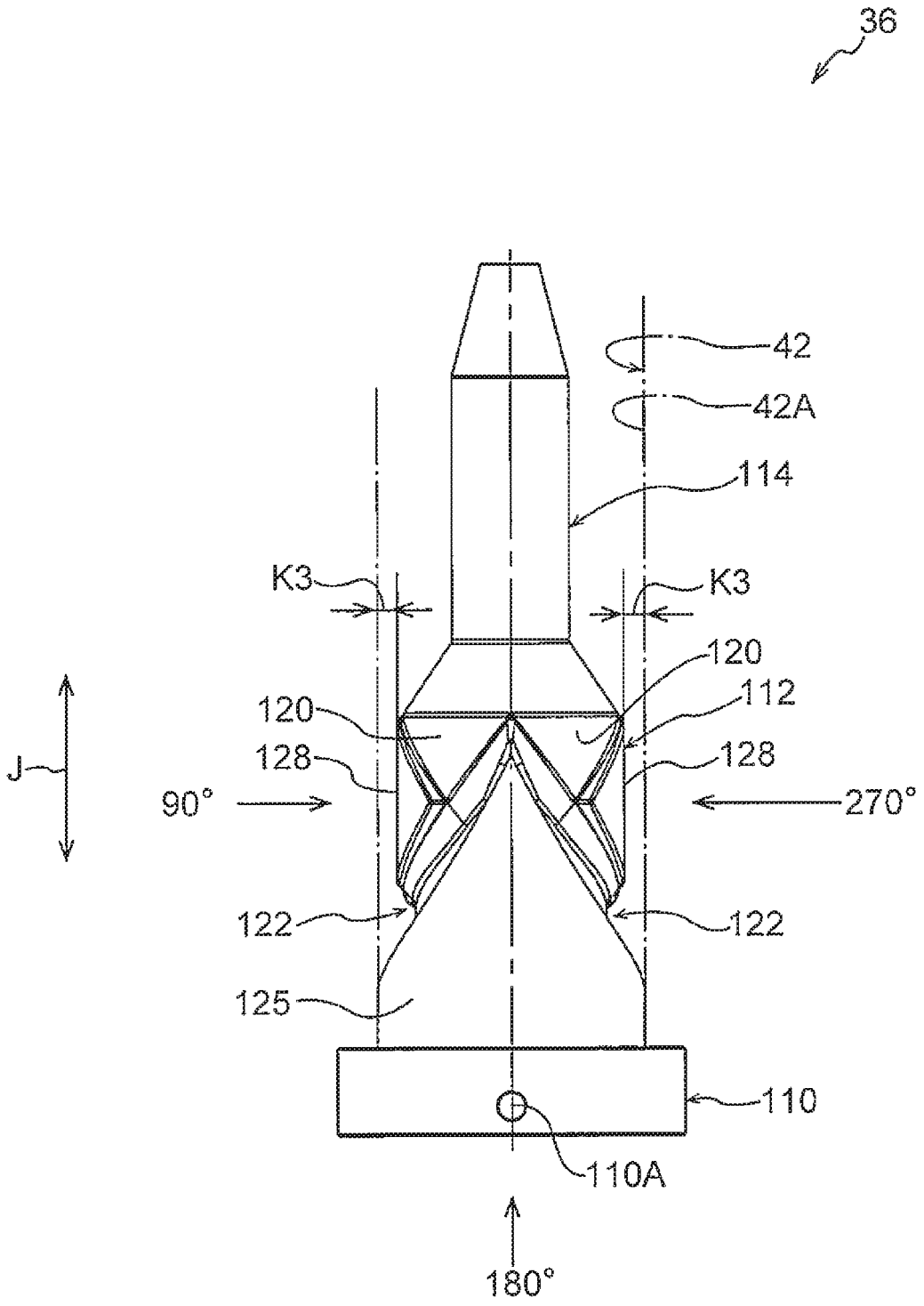
FIG. 8 is a back view of the mandrel, which is an example of a flow-path forming portion.
Figure 9:
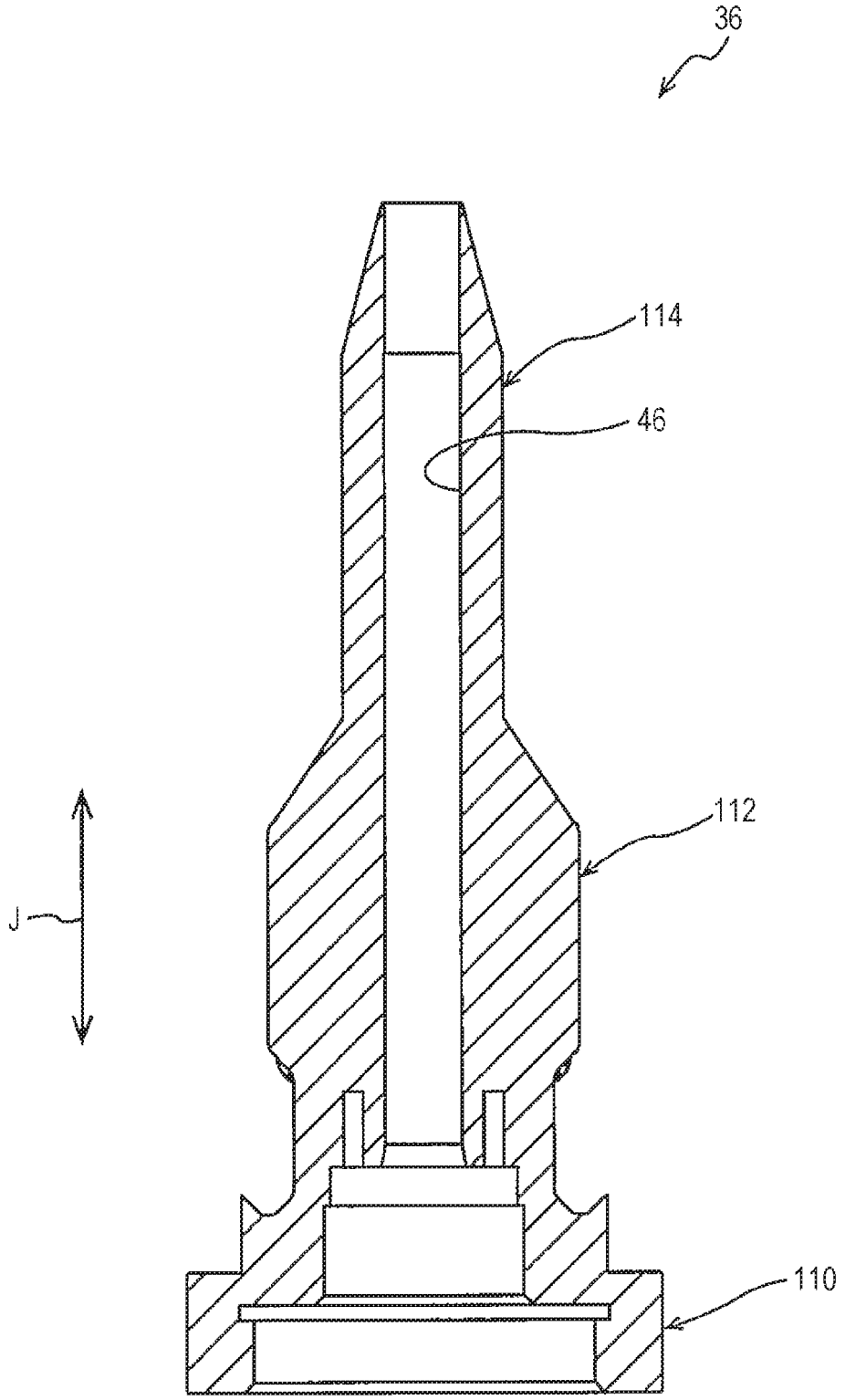
FIG. 9 is a sectional view of the mandrel taken along line IX-IX of FIG. 7.

Each groove 122 extends from the zero-degree position to the 180-degree position while extending obliquely from the base toward the tip end of the mandrel 36. As illustrated in FIGS. 5 and 8, the tip ends of the grooves 122 are connected at the 180-degree position. As illustrated in FIG. 6, a ridge 124, protruding in a mountain shape, extends in a groove bottom 122A of each groove 122 in the groove width direction at the zero-degree position. The ridge 124 is thus capable of allotting the rubber member 100 input from the inlet port 102 to the left and right grooves 122.

As illustrated in FIG. 7, each groove 122 has a clearance K, which is from the groove bottom 122A to the inner circumferential surface 42A, of within the range of 1.1 D to 1.5 D, where the clearance from the reference surface 120 to the inner circumferential surface 42A of the holding member 42 is denoted with D.

A thick portion 125, protruding from the reference surface 120, is formed between the grooves 122 and the base 110. When the mandrel 36 is inserted into the holding member 42 of the extruding portion 20, the thick portion 125 is fitted to the inner circumferential surface 42A of the holding member 42 while touching the inner circumferential surface 42A.

As illustrated in FIG. 6, an inlet-side protruding surface 126, which is an example of a protruding surface, is formed in an area of the reference surface 120 located on the tip end side of the grooves 122 within a range of at least 0°±10°. The inlet-side protruding surface 126 protrudes in a shape of a triangular having its apex directing the tip end side of the mandrel 36 when viewed from a zero-degree direction. As illustrated in FIG. 7, the clearance K2 from the inlet-side protruding surface 126 to the inner circumferential surface 42A is determined to be 0.5 D to 0.9 D.

As illustrated in FIGS. 6 and 7, side protruding surfaces 128, which are an example of a protruding surface, are formed over areas of the reference surface 120 located on the tip end side of the grooves 122 within ranges of at least 90°±10° and at least 270°±10°. Each side protruding surface 128 has a shape of an approximate quadrangle when viewed from the 90-degree direction or the 270-degree direction. One side of each quadrangle is aligned with the corresponding groove 122 and opposing corners of the quadrangle are respectively directed toward the tip end and base end. As illustrated in FIG. 8, the clearance K3 from each side protruding surface 128 to the inner circumferential surface 42A is determined to fall within the range of 0.5 D to 0.9 D. Reference surfaces 120 are disposed at portions between the inlet-side protruding surface 126 and each side protruding surface 128 and on the tip-end side of the inlet-side protruding surface 126 and the side protruding surfaces 128.

As illustrated in FIG. 7, a flow path having the clearance K is formed along each groove 122 and a flow path having the clearance K2 is formed along the inlet-side protruding surface 126 between the base end portion 112 of the mandrel 36 and the inner circumferential surface 42A of the holding member 42 of the extruding portion 20. As illustrated in FIGS. 7 and 8, a flow path having the clearance K3 is formed along the side protruding surface 128, and a flow path having the clearance D is formed along the reference surface 120 between the base end portion 112 and the inner circumferential surface 42A.

As illustrated in FIGS. 5 and 6, the distal end portion 114 has a shape of a cylindrical tube having a smaller diameter than the base end portion 112 and having a through hole 46 (see FIG. 9) extending through its center portion. The distal end portion 114 is rotation symmetric with respect to its axis. The distal end portion 114 includes a basal tapering portion 114A, which is disposed adjacent to the base end portion 112 and tapers toward the tip end, a cylindrical tube portion 114B, which extends toward the tip end from the basal tapering portion 114A, and a distal tapering portion 114C, which tapers toward the tip end from the cylindrical tube portion 114B.

As illustrated in FIG. 6, the length of the distal end portion 114 in the axial direction is determined so that the length ratio L1:L2 falls within the range of 3:7 to 5:5 where the length of the base end portion 112 in the axial direction is denoted by L1 and the length of the distal end portion 114 is denoted by L2. Specifically, (the length L1 of the base end portion 112)/(the length L2 of the distal end portion 114) falls within the range of 3/7 to 5/5.

Core Transporting Portion

As illustrated in FIG. 4, the core transporting portion 24 includes multiple (for example, three) pairs of rollers 50 disposed above the mandrel 36. One (on the left) of rollers 50 of each pair is connected to a driving roller 54 with a belt 52 interposed therebetween. When the driving roller 54 is driven, the core 22 held between the pairs of rollers 50 is transported toward the through hole 46 of the mandrel 36. The core 22 has a predetermined length. A core 22 transported by the pairs of rollers 50 pushes a preceding core 22 in the through hole 46 of the mandrel 36, so that multiple cores 22 sequentially pass through the through hole 46.

In the core transporting portion 24, the pairs of rollers 50 transport the core 22 downward in the vertical direction. Driving of the driving roller 54, which drives the pairs of rollers 50, is temporarily stopped when the tip end of the preceding core 22 arrives at the tip end of the mandrel 36. Then, the rubber member 100 is extruded into a cylindrical tubular shape in the merging area 48 and the core 22 is sequentially transported into the rubber member 100 while leaving a gap in the center portion of the rubber member 100. Thus, a rubber roller portion 56, which includes a core 22 having its outer circumferential surface covered with the rubber member 100, and a hollow portion 58, which is a hollow space inside of the rubber member 100 between the cores 22, are alternately discharged from the discharge head 38. Here, a primer (adhesive layer) may be applied, in advance, to the outer circumferential surface of the core 22 to enhance adhesion with the rubber member 100.

Separator

The separator 14 includes a pair of semi-cylindrical tubular separation members 60. The pair of separation members 60 are disposed so as to face each other to hold therebetween the rubber roller portion 56 extruded from the extruder 12. Each separation member 60 includes a protrusion 62, which protrudes toward the center portion. The separation members 60 are laterally movable, in FIG. 4, by a driving mechanism (not illustrated) to separate a preceding rubber roller portion 56 and a subsequent rubber roller portion 56 from each other. Thus, a rubber roller body (not illustrated) in which the preceding core 22 is enclosed is formed.

Pull-Out Device

The pull-out device 16 includes a pair of semi-cylindrical tubular clamping members 64. The pair of clamping members 64 are disposed so as to face each other to hold the rubber roller portion 56 extruded from the extruder 12 therebetween. Each clamping member 64 includes a clamping portion 66 having a shape corresponding to the shape of the outer circumferential surface of the rubber roller portion 56. Each clamping member 64 is laterally and vertically movable by a driving mechanism (not illustrated).

The rubber roller body, in which the core 22 is enclosed, formed by the rubber-roller manufacturing apparatus 10 is placed in a vulcanization furnace, as needed, to perform vulcanization on the rubber member 100 covering the core 22.

The rubber member 100 of the vulcanized rubber roller body has its both end portions cut so that the core 22 is exposed by a predetermined length at both end portions in the axial direction. Specifically, portions of the rubber member 100 covering the end surfaces of the core 22 are cut off. Thus, a rubber roller (member including an elastic layer on an electroconductive base member) is manufactured.

Thereafter, as needed, a surface layer is disposed on the elastic layer of the rubber roller (member including an elastic layer on an electroconductive base member) to form a charging member.

Here, the surface layer is formed by, for example, applying a liquid obtained by dissolving or dispersing the above components in a solvent to the electroconductive base member (outer circumferential surface of the elastic layer) by a method such as immersion, blade coating, spraying, vacuum deposition, or plasma coating, and drying the coated film.

Image Forming Apparatus, Charging Device, and Process Cartridge

An image forming apparatus according to the present exemplary embodiment includes an image carrier, a charging device that charges a surface of the image carrier, an exposure device that exposes the charged surface of the image carrier to light to form a latent image on the surface, a developing device that develops the latent image formed on the surface of the image carrier with toner into a toner image, and a transfer device that transfers the toner image formed on the surface of the image carrier to a recording medium. An example used as the charging device is a charging device including a charging member according to the present exemplary embodiment and the charging member is disposed in contact with the surface of the image carrier (or a charging device according to the present exemplary embodiment).

A process cartridge according to the present exemplary embodiment is, for example, attachable to and removable from an image forming apparatus having the above structure. The process cartridge includes an image carrier and a charging device that charges a surface of the image carrier. An example used as the charging device is a charging device according to the exemplary embodiment.

A process cartridge according to the present exemplary embodiment may include, as needed, for example, at least one selected from a group consisting essentially of an exposure device that exposes the charged surface of the image carrier to light to form a latent image, a developing device that develops the latent image formed on the surface of the image carrier with toner into a toner image, a transfer device that transfers the toner image formed on the surface of the image carrier to a recording medium, and a cleaning device that cleans the surface of the image carrier.

Here, in an image forming apparatus and a process cartridge according to the present exemplary embodiment, the exposure device is preferably an exposure device including a light emitting diode as a light source. In addition, the image carrier, the charging member, and the exposure device are preferably integrally held in the housing.

An example of the exposure device including a light emitting diode as a light source is an exposure device that includes a light emitting diode array, which includes light emitting diodes arrayed in the axial direction of an image carrier, a printed-circuit board, which includes a circuit that drives the light emitting diodes, and an imaging portion, which forms an image on the surface of the image carrier from light emitted from the light emitting diodes.

Specifically, an example of the exposure device is a self-scanning LED print head including a printed-circuit board and a rod lens array as an imaging portion (such as SELFOC lens array, where SELFOC is a registered trade mark of Nippon Sheet Glass Co. Ltd.). Multiple light emitting portions (light emitting thyristors) and a circuit are mounted on the printed-circuit board. The light emitting portions have a thyristor structure in which a light emitting diode array and its driving portion are integrated together. The circuit controls driving of the light emitting thyristor array.

Subsequently, an image forming apparatus and a process cartridge according to the present exemplary embodiment are described with reference to the drawings.

Figure 3:
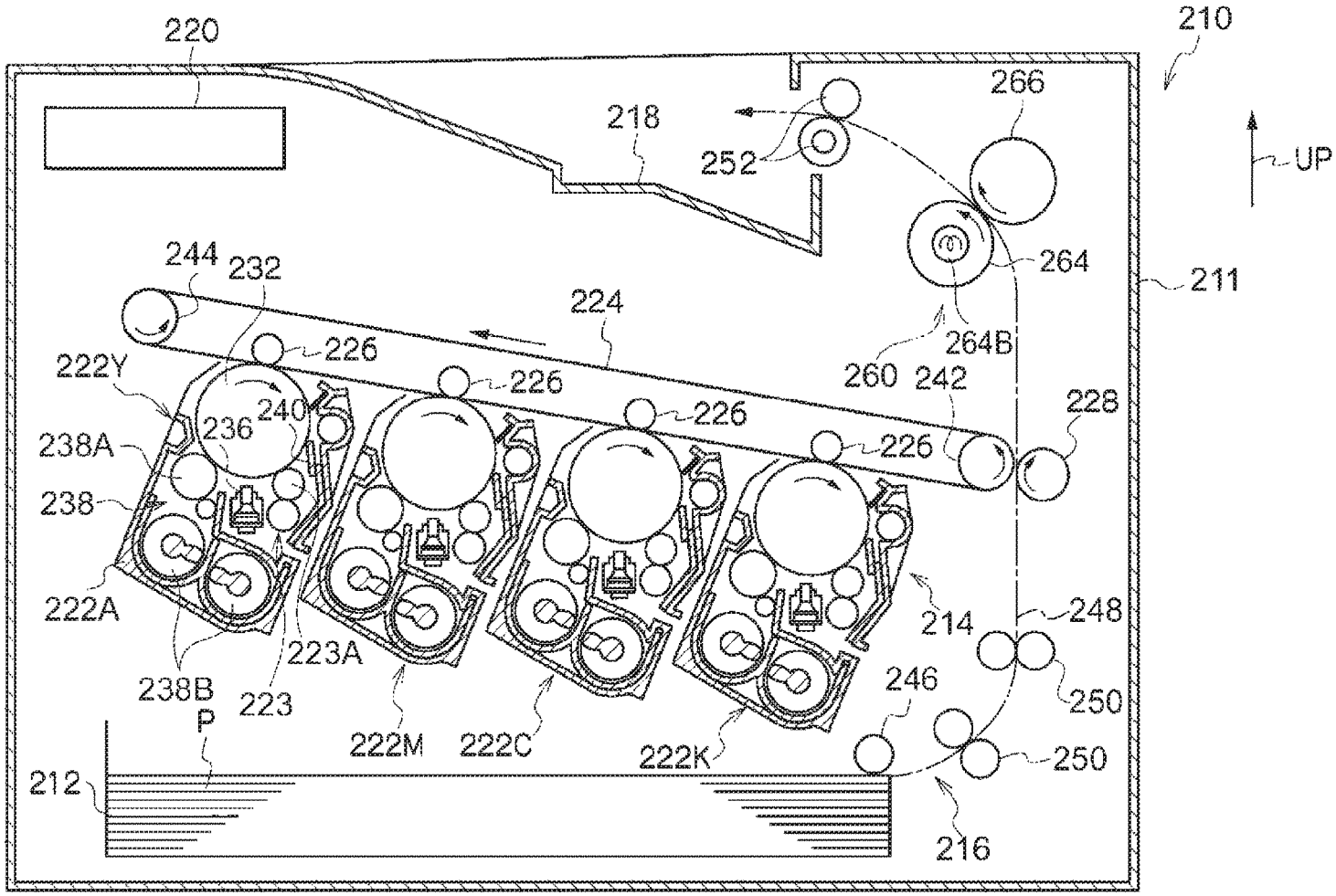
FIG. 3 is a schematic diagram of a structure of an image forming apparatus according to the present exemplary embodiment.

FIG. 3 is a schematic structure of an image forming apparatus according to the present exemplary embodiment. Arrow UP in FIG. 3 denotes upward in the vertical direction.

As illustrated in FIG. 3, an image forming apparatus 210 includes an image forming apparatus body 211 which holds variable components. The image forming apparatus body 211 holds a container portion 212, which holds recording media P such as paper sheets, an image forming portion 214, which forms images on the recording media P, a transporting portion 216, which transports the recording media P from the container portion 212 to the image forming portion 214, and a controller 220, which controls the operations of the components of the image forming apparatus 210. A discharging portion 218, to which the recording media P carrying images formed by the image forming portion 214 are discharged, is disposed at an upper portion of the image forming apparatus body 211.

The image forming portion 214 includes image forming units 222Y, 222M, 222C, and 222K (hereinafter referred to as 222Y to 222K), which respectively form toner images of yellow (Y), magenta (M), cyan (C), and black (K), an intermediate transfer belt 224, to which toner images formed by the image forming units 222Y to 222K are transferred, first transfer rollers 226, which transfer toner images formed by the image forming units 222Y to 222K to the intermediate transfer belt 224, and a second transfer roller 228, which transfers the toner images transferred to the intermediate transfer belt 224 by the first transfer rollers 226 from the intermediate transfer belt 224 to the recording media P. Here, the structure of the image forming portion 214 is not limited to the above structure and the image forming portion 214 may have other structures as long as it forms images on the recording media P.

Here, a unit including the intermediate transfer belt 224, the first transfer rollers 226, and the second transfer roller 228 corresponds to an example of a transfer device.

The image forming units 222Y to 222K are arranged obliquely with respect to the horizontal direction in a middle portion of the image forming apparatus 210 in the vertical direction. Each of the image forming units 222Y to 222K includes a photoconductor 232 (an example of an image carrier) that rotates in one direction (for example, clockwise in FIG. 3). The image forming units 222Y to 222K have the same structure. Thus, FIG. 3 excludes reference sings of the components of the image forming units 222M, 222C, and 222K.

Each image forming unit includes the following components around the corresponding photoconductor 232, in order from the upstream side in a rotation direction of the photoconductor 232: a charging device 223, which includes a charging roller 223A that charges the photoconductor 232; an exposure device 236, which exposes the photoconductor 232 charged by the charging device 223 to light to form a latent image on the photoconductor 232; a developing device 238, which develops the latent image formed on the photoconductor 232 by the exposure device 236 into a toner image; and a removing member (cleaning blade or the like) 240, which comes into contact with the photoconductor 232 to remove toner remaining on the photoconductor 232.

Here, the photoconductor 232, the charging device 223, the exposure device 236, the developing device 238, and the removing member 240 are integrally held in a housing 222A in the form of a cartridge (process cartridge).

An example of the exposure device 236 is a self-scanning LED print head. The exposure device 236 may alternatively be an exposure device having an optical system that exposes the photoconductor 232 to light from a light source through a polygon mirror.

The exposure device 236 forms a latent image on the basis of an image signal transmitted thereto from the controller 220. Examples of an image signal transmitted thereto from the controller 220 include an image signal that the controller 220 receives from an external device.

The developing device 238 includes a developer feeder 238A, which feeds a developer to the photoconductor 232, and multiple transporting members 238B, which agitate and transport the developer fed to the developer feeder 238A.

The intermediate transfer belt 224 is annular and disposed above the image forming units 222Y to 222K. Tension rollers 242 and 244 are disposed on the inner peripheral side of the intermediate transfer belt 224 to allow the intermediate transfer belt 224 to be wound around them. The intermediate transfer belt 224 circularly moves (rotates) in one direction (for example, counterclockwise in FIG. 3) while being in contact with the photoconductors 232 when either one of the tension rollers 242 and 244 is driven to rotate. The tension roller 242 is an opposing roller that faces the second transfer roller 228.

Each first transfer roller 226 faces the corresponding photoconductor 232 with the intermediate transfer belt 224 interposed therebetween. A portion between each first transfer roller 226 and the corresponding photoconductor 232 serves as a first transfer position at which the toner image formed on the photoconductor 232 is transferred to the intermediate transfer belt 224.

The second transfer roller 228 faces the tension roller 242 with the intermediate transfer belt 224 interposed therebetween. A portion between the second transfer roller 228 and the tension roller 242 serves as a second transfer position at which the toner images transferred to the intermediate transfer belt 224 are transferred to a recording medium P.

The transporting portion 216 includes a pick-up roller 246, which picks up a recording medium P held in the container portion 212, a transport path 248, along which the recording medium P picked up by the pick-up roller 246 is transported, and multiple transport rollers 250, which are arranged along the transport path 248 to transport the recording medium P picked up by the pick-up roller 246 to the second transfer position.

A fixing device 260 is disposed downstream of the second transfer position in the transportation direction. The fixing device 260 fixes the toner image formed on the recording medium P by the image forming portion 214 to the recording medium P.

The fixing device 260 includes a heating roller 264, which heats an image on the recording medium P, and a pressing roller 266, which is an example of a pressing member. The heating roller 264 includes a heat source 264B therein.

Discharging rollers 252 are disposed downstream of the fixing device 260 in a transportation direction. The discharging rollers 252 discharge the recording medium P onto which the toner image is fixed to the discharging portion 218.

An operation of the image forming apparatus 210 to form an image on a recording medium P is described now.

In the image forming apparatus 210, the pick-up roller 246 picks up a recording medium P from the container portion 212 and the multiple transport rollers 250 transport the recording medium P to the second transfer position.

In each of the image forming units 222Y to 222K, the exposure device 236 exposes the photoconductor 232 charged by the charging device 223 to light to form a latent image on the photoconductor 232. The developing device 238 develops the latent image to form a toner image on the photoconductor 232. The toner images of respective colors formed by the image forming units 222Y to 222K are superposed one on top of another on the intermediate transfer belt 224 at the first transfer positions and formed into a color image. The color image formed on the intermediate transfer belt 224 is transferred to the recording medium P at the second transfer position.

The recording medium P to which the toner image has been transferred is transported to the fixing device 260 and the transferred toner image is fixed by the fixing device 260. The recording medium P to which the toner image has been fixed is discharged by the discharging rollers 252 to the discharging portion 218. A series of the image forming operation is performed in the above manner.

The structure of the image forming apparatus 210 according to the present exemplary embodiment is not limited to the one described above. For example, the image forming apparatus 210 may be any of other known image forming apparatuses, such as a direct-transfer image forming apparatus that directly transfers toner images formed on the photoconductors 232 of the image forming units 222Y to 222K to a recording medium P.

EXAMPLES

The present invention is further described in detail below on the basis of examples. The present invention, however, is not limited to the examples below. Parts are by weight unless otherwise specified.

Examples 1 to 11 and Comparative Examples 1 to 2

Manufacturing of Rubber Roller (Forming of Elastic Layer)

A rubber roller is manufactured using a "60 mm single-axis vent-type rubber extruder" from Mitsuba Mfg. Co., Ltd., corresponding to the rubber-roller manufacturing apparatus illustrated in FIGS. 4 to 9. Specifically, a core made of SUS303 and having a diameter of 8 mm and a length of 330 mm is prepared. A rubber member having the following composition is extruded into a cylinder tube shape from an extruding portion of the rubber-roller manufacturing apparatus set in the following manner (conditions are changeable as described in Table 1), the core is fed to the center portion of the extruded rubber member, and the outer circumferential surface of the core is covered with the cylindrical tubular rubber member. Then, an unvulcanized rubber roller, which includes the core and the rubber member covering the outer circumferential surface of the core, is vulcanized at 160° C. for 60 minutes in an air heating furnace. This obtains a rubber roller having an outer diameter of 12.00 mm and having a core (electroconductive base member) whose outer circumferential surface is covered with a vulcanized rubber member (elastic layer).

Comparative Example 1 is a rubber roller formed by grinding the outer circumferential surface to have an outer diameter of 11.99 mm. Comparative Example 2 is also a rubber roller formed by grinding the outer circumferential surface to have an outer diameter of 11.99 mm.

Materials of Rubber Member

- Rubber (epichlorohydrin-ethylene oxide-allyl glycidyl ether copolymer, Hydrin T3106 from Zeon Corporation): 100 parts by weight
- Electroconductive agent (carbon black, Asahi Thermal from Asahi Carbon Co., Ltd.): 20 parts by weight
- Electroconductive agent (ketjenblack EC from Lion Corporation): 2 parts by weight
- Ion electroconductive agent (benzyltrimethylammonium chloride, product name "BTEAC" from Lion Specialty Chemicals Co., Ltd.): 1 part by weight
- Vulcanizing agent (organic sulfur, 4,4'-dithiodimorpholine, VULNOC R from Ouchi Shinko Chemical Industrial Co., Ltd): 1.5 parts by weight
- Vulcanization accelerator (di-2-benzothiazolyl disulfide, NOCCELER DM-P from Ouchi Shinko Chemical Industrial Co., Ltd): 1.5 parts by weight
- Vulcanization accelerator (tetraethylthiuram disulfide, NOCCELER TET-G from Ouchi Shinko Chemical Industrial Co., Ltd): 1.8 parts by weight
- Vulcanization supplement accelerator (zinc oxide, one type of zinc oxide from Seido Chemical Industry Co., Ltd.): 3 parts by weight
- Stearic acid: 1.0 part by weight
- Heavy calcium carbonate: 40 parts by weight Conditions of Rubber-Roller Manufacturing Apparatus Basic Conditions

- Cylindrical tubular body (cylinder): Length Ls of 1200 mm, Inner diameter ID of 60 mm, and Ls/ID of 20
- Screw rotation rate: 16 rpm
- Extrusion pressure: 23 MPa
- Core: Full length of 350 mm, and Outer diameter ϕ of 8.0 mm
- Discharge head diameter (Die diameter) ϕ: 12.5 mm Variable Conditions Mandrel (see FIGS. 4 to 9)

A: clearance K2 from the inlet-side protruding surface 126 of the mandrel 36 to the inner circumferential surface 42A=0.6 D mm, clearance K3 from the side protruding surface 128 to the inner circumferential surface 42A=0.8 D mm, clearance K from the groove bottom 122A of the groove 122 to the inner circumferential surface 42A=1.2 D mm, and ratio L1:L2=4:6, where L1 denotes the length of the base end portion 112 of the mandrel 36, and L2 denotes the length of the distal end portion 114

B: clearance K2=0.7 D mm, clearance K3=0.5 D mm, clearance K=1.1 D mm, and ratio L1:L2=5:5

C: clearance K2=0.7 D mm, clearance K3=0.7 D mm, clearance K=1.0 D mm, and ratio L1:L2=4:6

Breaker plate

A: Hole outer diameter ϕ of 0.8 mm to 1.1 mm, and the number of holes of 120

B: Hole outer diameter ϕ of 1.0 mm, and the number of holes of 90

C: Hole outer diameter ϕ of 1.3 mm, and the number of holes of 60

Discharge head temperature (die temperature)

A: 100° C.

B: 90° C.

C: 80° C.

Formation of Surface Layer

- Binding resin, N-methoxymethylated nylon (product name F30K from Nagase ChemteX Corporation): 100 parts by weight
- Particle A, carbon black (product name MONARCH 1000 from Cabot Corporation): 15 parts by weight
- Particle B, polyamide particle (polyamide 12 from ARKEMA K.K.): 20 parts by weight
- Additives, dimethylpolysiloxane (BYK-307 from ALTANA AG): 1 part by weight The mixture of the above compositions is diluted with methanol and dispersed by a bead mill to obtain a dispersion, and the dispersion is applied to the surface of the obtained rubber roller so that the surface is immersed in the dispersion. Then, the resultant is heated at 130° C. for 30 minutes to be dried, so that a surface layer having a thickness of 9 μm is formed. Thus, a charging member (charging roller) of each example is obtained.

Evaluations

The charging members (charging rollers) of the respective examples are subjected to the following evaluation. The results are shown in Table 1.

Surface Profile Properties of Charging Members

Measurements are performed in the above-described methods to find the surface profile properties of the charging member, including 1) the maximum amplitude in a period region of smaller than 5 mm, 2) the maximum amplitude in a period region of higher than or equal to 5 mm and smaller than or equal to L mm, and 3) the average amplitude in a period region of higher than or equal to 1.5 mm and smaller than 5 mm.

Image Density Irregularity

The charging member of each example is attached to ApeosPort-VI C7771 (a cartridge-form device integrally holding a photoconductor, a charging member, a self-scanning LED print head serving as an exposure device, a developing device, and a cleaning blade in a housing) from Fuji Xerox.

This device forms images under the conditions of A3 P sheets (from Fuji Xerox), a monochrome mode, an entirely half-tone, and an image density of 60%, and then the density irregularity of each image is graded. Grading is from G0 to G5 in increments of 0.5. The density irregularity is less with the smaller number of G. The acceptable grade of the density irregularity is G4.5.

direction, the surface profile has a maximum amplitude, in a period region of smaller than 5 mm, within a range of higher than or equal to 0.20 μm and smaller than or equal to 0.90 μm, wherein when the surface profile of the charging member is subjected to the periodicity analysis in the circumferential direction, the surface profile has a maximum amplitude, in a period region of higher than or equal to 5 mm and smaller than or equal to L mm, within a range of higher than or equal to 1.0 μm and smaller than or equal to 5.0 μm, where an outer perimeter of the charging member is denoted with L mm, and wherein said surface profile is of an outermost layer of the charging member.

2. The charging member according to claim 1, wherein the maximum amplitude in the period region of smaller than 5 mm falls within a range of higher than or equal to 0.20 μm and smaller than or equal to 0.60 μm.

TABLE 1

| | Rubber roller manufacturing conditions (variable conditions) | | | | Surface profile properties of charging member | | | |
|---|---|---|---|---|---|---|---|---|
| | Grinding of outer circumferential surface | Mandrel | Breaker plate | Die temperature | Maximum amplitude in period region of smaller than 5 mm | Maximum amplitude in period region of higher than or equal to 5 mm and smaller than or equal to L mm | Average amplitude in period region of higher than or equal to 1.5 mm and smaller than 5 mm | Evaluation Image Density Irregularity |
| Example 1 | Not Ground | A | A | A | 0.21 | 1.2 | 0.11 | G0.5 |
| Example 2 | Not Ground | A | B | A | 0.42 | 1.6 | 0.28 | G0.5 |
| Example 3 | Not Ground | A | B | B | 0.43 | 1.6 | 0.32 | G1.0 |
| Example 4 | Not Ground | A | B | C | 0.48 | 1.7 | 0.33 | G2.0 |
| Example 5 | Not Ground | A | C | A | 0.58 | 1.9 | 0.34 | G2.0 |
| Example 6 | Not Ground | A | C | B | 0.63 | 1.9 | 0.34 | G3.0 |
| Example 7 | Not Ground | A | C | C | 0.88 | 1.9 | 0.36 | G3.5 |
| Example 8 | Not Ground | B | A | A | 0.87 | 2.8 | 0.36 | G3.5 |
| Example 9 | Not Ground | B | B | A | 0.88 | 3.2 | 0.36 | G4.0 |
| Example 10 | Not Ground | C | A | A | 0.87 | 4.7 | 0.36 | G4.0 |
| Example 11 | Not Ground | C | B | A | 0.88 | 5.3 | 0.36 | G4.5 |
| Comparative Example 1 | Ground | A | A | A | 0.11 | 1.1 | 0.06 | G5.0 |
| Comparative Example 2 | Ground | C | A | A | 0.95 | 5.5 | 0.37 | G5.5 |

The above results reveal that the charging members (charging rollers) according to the examples cause less image density irregularity than the charging members (charging rollers) of the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for variable embodiments and with the variable modifications as are suited to the particular use contemplated. It is intended that the scope of the invention be defined by the following claims and their equivalents.

What is claimed is:

1. A charging member comprising:

a cylindrical, hollow or solid, electroconductive base member; and an elastic layer device disposed on the electroconductive base member, wherein when a surface profile of the charging member is subjected to a periodicity analysis in a circumferential

3. The charging member according to claim 2, wherein the maximum amplitude in the period region of smaller than 5 mm falls within a range of higher than or equal to 0.20 μm and smaller than or equal to 0.45 μm.

4. The charging member according to claim 1, wherein the maximum amplitude in the period region of higher than or equal to 5 mm and smaller than or equal to L mm falls within a range of higher than or equal to 1.0 μm and smaller than or equal to 3.0 μm.

5. The charging member according to claim 1, wherein when the surface profile of the charging member is subjected to the periodicity analysis in the circumferential direction, the surface profile has an average amplitude in a period region of higher than or equal to 1.5 mm and smaller than 5 mm, within a range of higher than or equal to 0.1 μm and smaller than or equal to 0.4 μm.

6. The charging member according to claim 5, wherein the average amplitude in the period region of higher than or equal to 1.5 mm and smaller than 5 mm falls within a range of higher than or equal to 0.1 μm and smaller than or equal to 0.3 μm.

7. The charging member according to claim 1, further comprising a surface layer on an outer circumferential surface of the elastic layer.

8. A process cartridge, comprising:

an image carrier;

a charging device that charges a surface of the image carrier and includes the charging member according to claim 1, the charging member being disposed in contact with the surface of the image carrier; and an exposure device that exposes the charged surface of the image carrier to light to form a latent image on the surface, wherein the process cartridge is attachable to and detachable from an image forming apparatus.

9. The process cartridge according to claim 8, wherein the exposure device includes a light emitting diode as a light source, and wherein the image carrier, the charging member, and the exposure device are integrally held in a housing.

10. An image forming apparatus, comprising:

an image carrier;

a charging device that charges a surface of the image carrier and includes the charging member according to claim 1, the charging member being disposed in contact with the surface of the image carrier;

an exposure device that exposes the charged surface of the image carrier to light to form a latent image on the surface;

a developing device that develops the latent image formed on the surface of the image carrier with toner into a toner image; and a transfer device that transfers the toner image formed on the surface of the image carrier to a recording medium.

11. The image forming apparatus according to claim 10, wherein the exposure device includes a light emitting diode as a light source, and wherein the image carrier, the charging member, and the exposure device are integrally held in a housing.

12. A charging member comprising:

a cylindrical, hollow or solid, electroconductive base member; and an elastic layer device disposed on the electroconductive base member, wherein when the surface profile of the charging member is subjected to the periodicity analysis in the circumferential direction, the surface profile has an average amplitude in a period region of higher than or equal to 1.5 mm and smaller than 5 mm, within a range of higher than or equal to 0.1 μm and smaller than or equal to 0.4 μm, and wherein said surface profile is of an outermost layer of the charging member.

13. The charging member according to claim 12, wherein the average amplitude in the period region of higher than or equal to 1.5 mm and smaller than 5 mm falls within a range of higher than or equal to 0.1 μm and smaller than or equal to 0.3 μm.

14. A process cartridge, comprising:

an image carrier;

a charging device that charges a surface of the image carrier and includes the charging member according to claim 12, the charging member being disposed in contact with the surface of the image carrier; and an exposure device that exposes the charged surface of the image carrier to light to form a latent image on the surface, wherein the process cartridge is attachable to and detachable from an image forming apparatus.

15. The process cartridge according to claim 14, wherein the exposure device includes a light emitting diode as a light source, and wherein the image carrier, the charging member, and the exposure device are integrally held in a housing.

16. An image forming apparatus, comprising:

an image carrier;

a charging device that charges a surface of the image carrier and includes the charging member according to claim 12, the charging member being disposed in contact with the surface of the image carrier;

an exposure device that exposes the charged surface of the image carrier to light to form a latent image on the surface;

a developing device that develops the latent image formed on the surface of the image carrier with toner into a toner image; and a transfer device that transfers the toner image formed on the surface of the image carrier to a recording medium.

17. The image forming apparatus according to claim 16, wherein the exposure device includes a light emitting diode as a light source, and wherein the image carrier, the charging member, and the exposure device are integrally held in a housing.

* * * * *